US006070289A

United States Patent [19]

Lee et al.

[11] Patent Number: 6,070,289

[45] Date of Patent: Jun. 6, 2000

[54] LOW NOISE VACUUM CLEANER

[75] Inventors: Nam-Ho Lee, Kunpo-Si; Jae-Duk Lee, Seoul, both of Rep. of Korea

[73] Assignee: Daewoo Electronics Co., Ltd., Seoul, Rep. of Korea

[21] Appl. No.: 09/080,246

[22] Filed: May 18, 1998

[30] Foreign Application Priority Data

Oct. 27, 1997 [KR] Rep. of Korea ..... 97-55330
Oct. 27, 1997 [KR] Rep. of Korea ..... 97-55332

[51] Int. Cl.[7] ..... A47L 9/22

[52] U.S. Cl. ..... 15/326; 15/327.2; 15/412

[58] Field of Search ..... 15/326, 412, 327.2, 15/327.7, 347

[56] References Cited

U.S. PATENT DOCUMENTS

| | | | |
|---|---|---|---|
| 4,597,131 | 7/1986 | Lyman | 15/412 |
| 4,617,034 | 10/1986 | Ikezaki et al. . | |
| 4,864,683 | 9/1989 | Herron, Jr. et al. | 15/326 |
| 5,293,664 | 3/1994 | Lim et al. . | |
| 5,513,417 | 5/1996 | Lim et al. | 15/326 |
| 5,720,074 | 2/1998 | Lee | 15/326 |
| 5,894,629 | 4/1999 | Kim | 15/326 |

FOREIGN PATENT DOCUMENTS

| | | |
|---|---|---|
| 0528451 | 2/1993 | European Pat. Off. . |
| 0636336 | 2/1995 | European Pat. Off. . |
| 4100858 A1 | 7/1992 | Germany . |
| 4-272733 | 9/1992 | Japan . |
| 5-84194 | 4/1993 | Japan . |
| 09066007A | 3/1997 | Japan . |
| 1602442 A1 | 10/1990 | U.S.S.R. . |
| 1768135 A1 | 10/1992 | U.S.S.R. . |

*Primary Examiner*—Robert J. Warden, Sr.
*Assistant Examiner*—Andrew Aldag
*Attorney, Agent, or Firm*—Pillsbury Madison & Sutro LLP

[57] ABSTRACT

A low noise vacuum cleaner is comprised of a dust collecting chamber having a paper filter, and air blowing chamber partitioned by a wall. The air blowing chamber comprises an air suction motor, a front casing, a rear casing having space established by assembling with the front casing, and the motor being housed in the space, and a first and a second air guiders which are housed in the rear casing. A periphery of the second air guider is sealedly disposed between the joint portion of the front casing and the rear casing.

3 Claims, 7 Drawing Sheets

LOW NOISE VACUUM CLEANER

BACKGROUND OF THE INVENTION

1. Field of the Invention

The present invention relates to a low noise vacuum cleaner. More specifically, the invention relates to a low noise vacuum cleaner in which a sealing component is arranged between a joint portion of a front casing and a rear casing which has a motor therein.

2. Description of the Prior Art

Generally, a vacuum cleaner exhibits function for collecting dust collecting on a surface to be cleaned by strong intake force which is generated by operation of a motor. The typical vacuum cleaner is shown in FIG. 7, in which a body 110 is comprised of a dust collecting chamber 120 and an air blowing chamber 130 which are partitioned by a wall 111. Further, plural rollers 119 are equipped for freely moving the body 110. Furthermore, an intaking brush (not shown) is provided for drawing dust collecting on the surface to be cleaned, and multi step pipe (not shown) which is connected to the front portion of the body 110 is provided. If necessary, flexible pipe is detachably arranged between the brush and the pipe for forming a long air passage.

A paper filter 125 is provided in the dust collecting chamber 120, and the dust accompanying air which passes through the brush, multi step pipe and flexible pipe sequentially is filtered by the paper filter 125. Further, an air opening 112 is formed at the wall 111 for exclusively passing the dust filtered air. Furthermore, a motor 131 is provided in the air blowing chamber 130, which is intercommunicated with the opening 112.

The air drawn into the body 110 passes through the paper filter 125 of the dust collecting chamber 120, the opening 112, the air blowing chamber 130, and finally through the rear of the body 110, thus establishing an air discharge path.

However, when a vacuum cleaner employing the conventional air blowing chamber 130 is utilized in the cleaning work, the sealability of the joint portion of the front/rear casings 143,144 which are separably assembled by the thread component (not shown) is poor. Part of the air discharged through the air outlet 142 of the motor 131 passes through the outlet grill 151 having a filter, whereas the remaining part of the air, i.e., the still dust laided air, is discharged through the gap of the joint portion.

A user and nearby persons can breathe the dusty air, which has a bad effect upon the health of the person. Moreover, noise of the motor can emerge through the possible gap of the front/rear casing assembly.

SUMMARY OF THE INVENTION

Therefore, it is an object of the present invention to provide a low noise vacuum cleaner which solves the problem.

It is another object of the present invention to provide a low noise vacuum cleaner which seals completely a gap of the joint portion of the body enclosing the motor, thus preventing noise of the motor from emerging from the motor.

It is another object of the present invention to provide a low noise vacuum cleaner by which the dust laiden air drawn by the motor passes exclusively through the filter, thereby the clean air is discharged to the circumference.

To achieve the above object of the present invention, in a low noise vacuum cleaner having a dust collecting chamber having a paper filter for collecting dust intaken via a brush pipe, and an air blowing chamber partitioned by a wall having an air opening from the dust collecting chamber, both of the chambers laying on a surface to be cleaned; the air blowing chamber is comprised of an air suction motor having an inlet for intaking the air from the dust collecting chamber, and having an outlet for discharging the intaken air, a front casing having an air inlet, a rear casing having a filter fitted to an air outlet through which the cleaned air is discharged parallel to the surface to be cleaned, and the assembled two casings instituting a space for housing the air suction motor, a damper contactedly disposed between the motor and the front casing, a first air guider housing the motor, and having plural air openings which are distanced from the air outlet of the motor, and a second air guider disposed between the first air guider and the rear casing, and having plural air openings which are provided to cause outlet air to move more indirectly to the filter of the rear casing, wherein a periphery of the second air guider being sealedly disposed between the joint portion of the front casing and the rear casing.

Further, a protuberance is provided along the periphery of the second air guider, and recesses are provided along the jointing periphery of the front casing and the rear casing, respectively, for enveloping the protuberance.

Alternatively, a protuberance is provided along the jointing periphery of the first casing and the second casing, respectively, and recesses formed facing opposite one another provided along the periphery of the second air guider, for receiving each protuberance.

Further, a ring gasket is arranged in a recess which is formed by the facing joint of each periphery of the front casing and the rear casing.

BRIEF DESCRIPTION OF THE DRAWINGS

The present invention may be better understood and its numerous objects and advantages will be more apparent to those skilled in the art by reference to the accompanying drawings in which.

DETAILED DESCRIPTION OF THE PREFERRED EMBODIMENT

Figure 1:
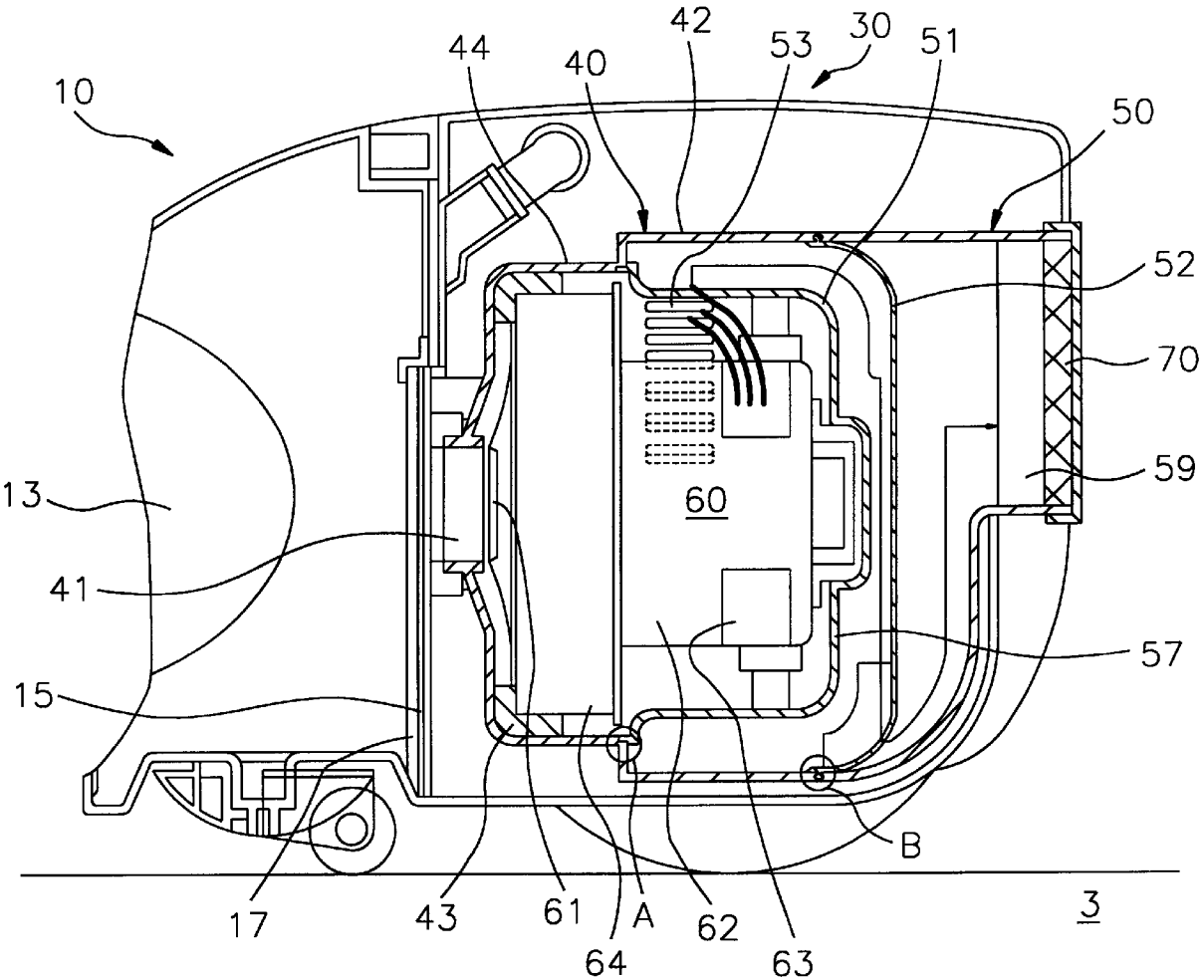
FIG. 1 is a side cross-sectional view of a body of vacuum cleaner according to the present invention.
Figure 2:
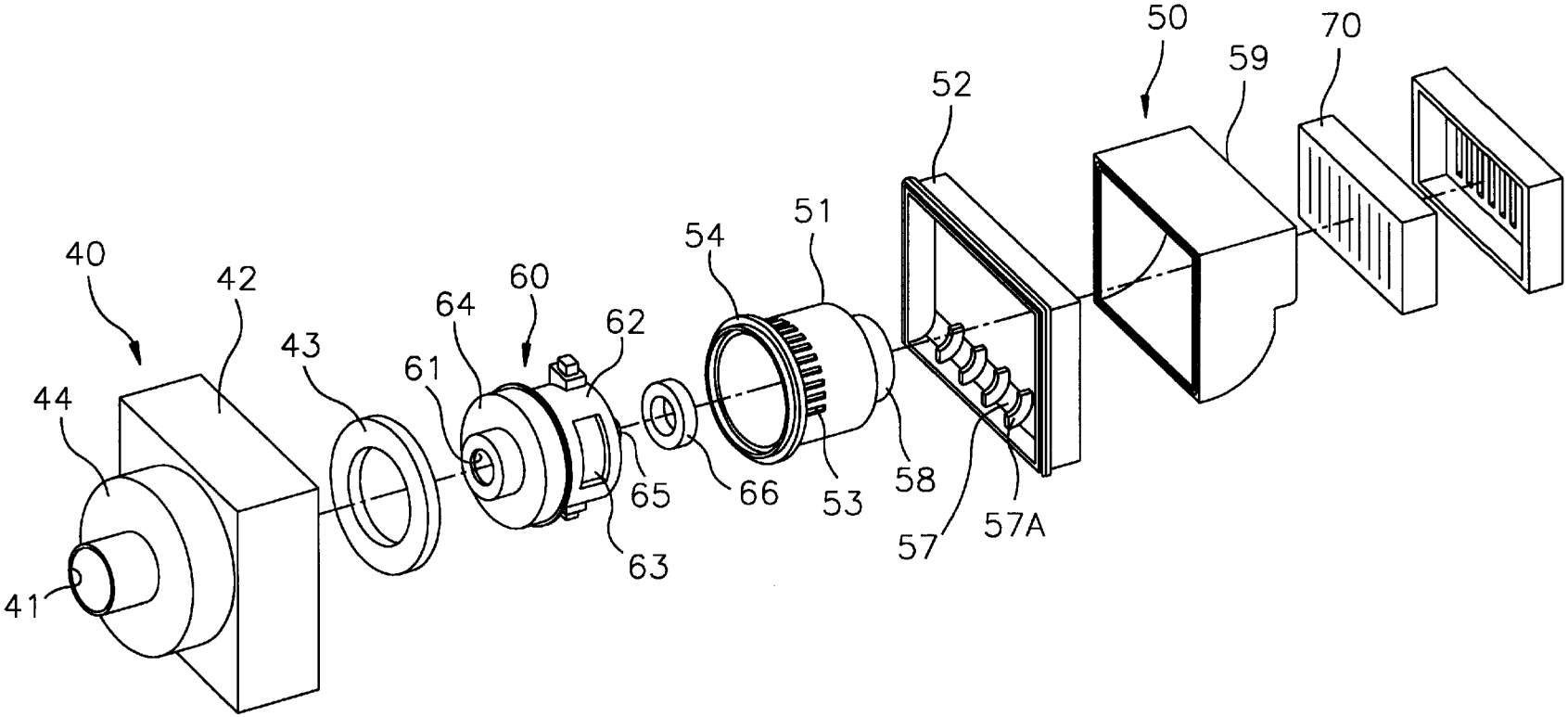
FIG. 2 is a perspective view of a disassembled air blowing chamber of a vacuum cleaner according to the present invention.

FIGS. 1, 2, 3 and 4 illustrate one embodiment of vacuum cleaner according to the present invention. The vacuum cleaner is comprised of a dust collecting chamber 10 disposed at a front section of a body, an air blowing chamber 30 disposed at a rear section of a body, and a wall 17 partitioning two chambers 10, 30. The dust collecting chamber 10 and the air blowing chamber 30 are placed on a surface 3 to be cleaned in a parallel manner. A paper filter 13 is installed in the dust collecting chamber 10, and the dust laiden air drawn into the dust collecting chamber 10 through the brush pipe (not shown) is filtered by the paper filter 13, and next flows to an opening 15 formed on the wall 17.

Figure 3:
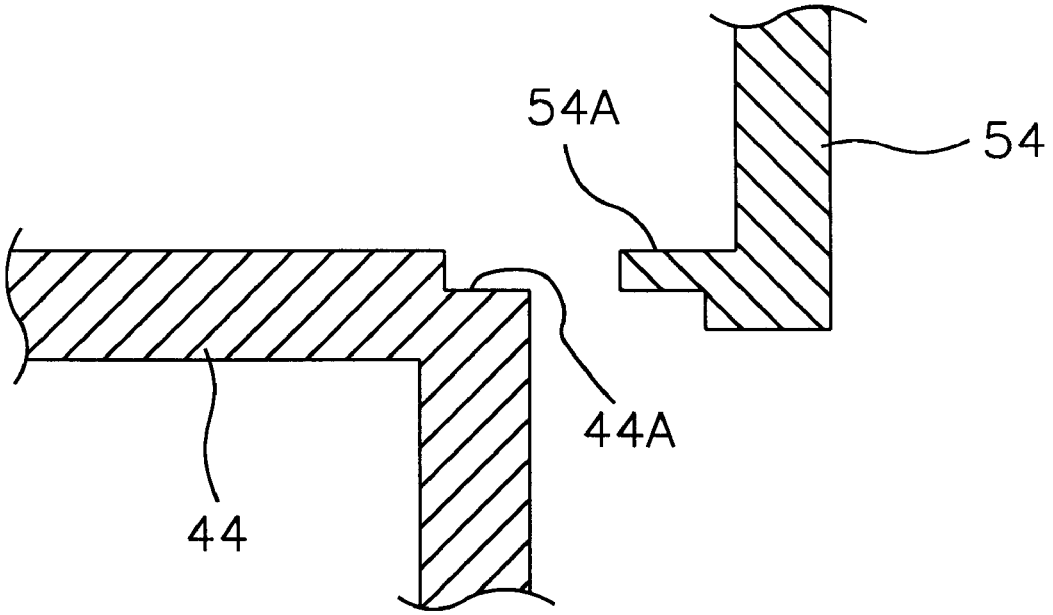
FIG. 3 is an enlarged side cross-sectional view of portion A of FIG. 1.

The air blowing chamber 30 is comprised of a front casing 40, a rear casing 50, and a motor 60 housed in space formed by the assembly of two casings 40, 50. The front casing 40 is comprised of a cylindrical front member 44 and a rectangular rear member 42. An opening 41 is formed at the front member 44 being coaxially aligned with the opening 15 of the wall 17. The opening 41 is also aligned with an inlet 61 of the motor 60. A damper 43 is disposed between the front member 64 of the motor 60 and the front member 44 of the front casing 40 to damper the driving vibration of the motor 60. Further, a first air guider 51 is provided to enclose the rear member 62 of the motor 60, and a protuberance 54A of the front circumference 54 of the first air guider 51 is fit snugly on a diametric step 44A formed at the front member 44 (FIG. 3). Plural slots 53 are formed on the first air guider 51, which are parallel to a shaft 65 of the motor 60, and the slots 53 are distanced from the air outlet 63 of the motor 60 to extend the air flow path. To dampen vibration of the motor 65 a damper 66 is disposed in the rear member 58 of the first air guider 51.

Figure 4:
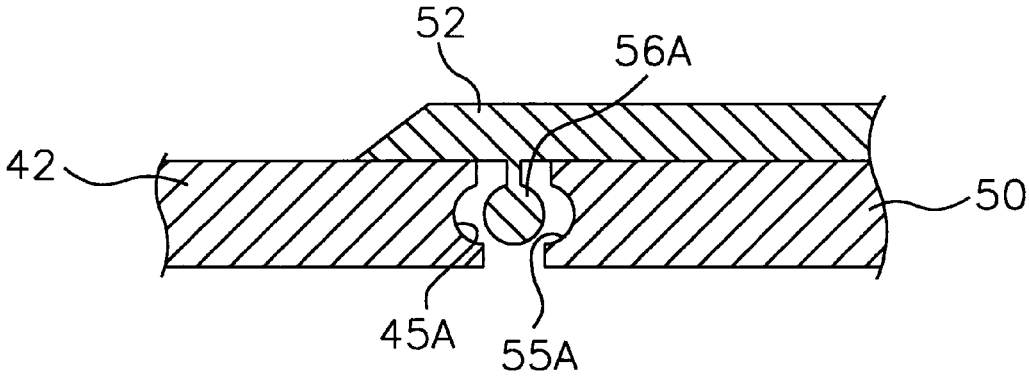
FIG. 4 is an enlarged side cross-sectional view of portion B of FIG. 1.

A second air guider 52 is provided behind the first air guider 51, and a protuberance 56A is formed at a circumference of the second air guider 52 as shown in FIG. 4. A recess 45A is formed at the circumference of the rear member 42 of the front casing to enclose the protuberance 56A, whereas the recess 55A is formed at the circumference of the rear casing 50.

Figure 5:
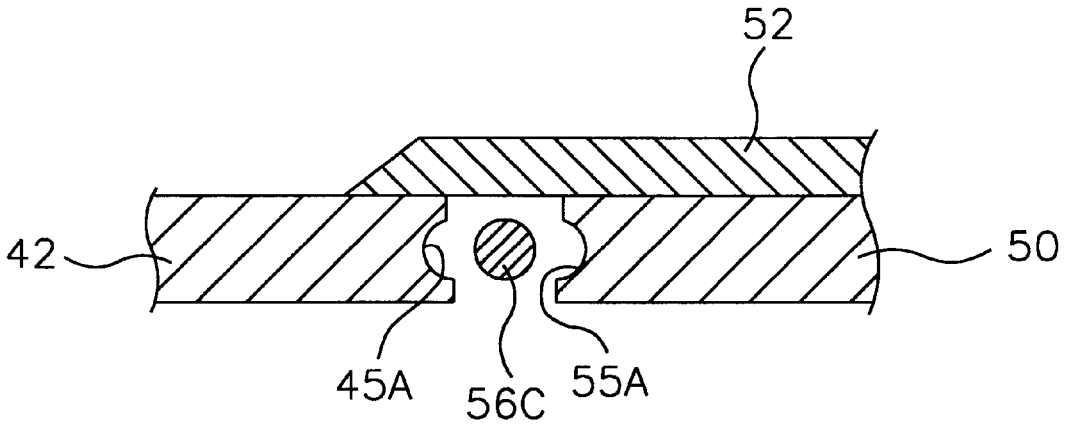
FIG. 5 is an enlarged side cross-sectional view of modified embodiment of FIG. 4.

Alternatively, as shown in FIG. 5 the protuberance 56A can be eliminated from the second air guider 52, and a ring gasket 56C can be installed into the space which is established with the recess 45A of the rear member 42 of the front casing and the recess 55A of the rear casing 50.

Figure 6:
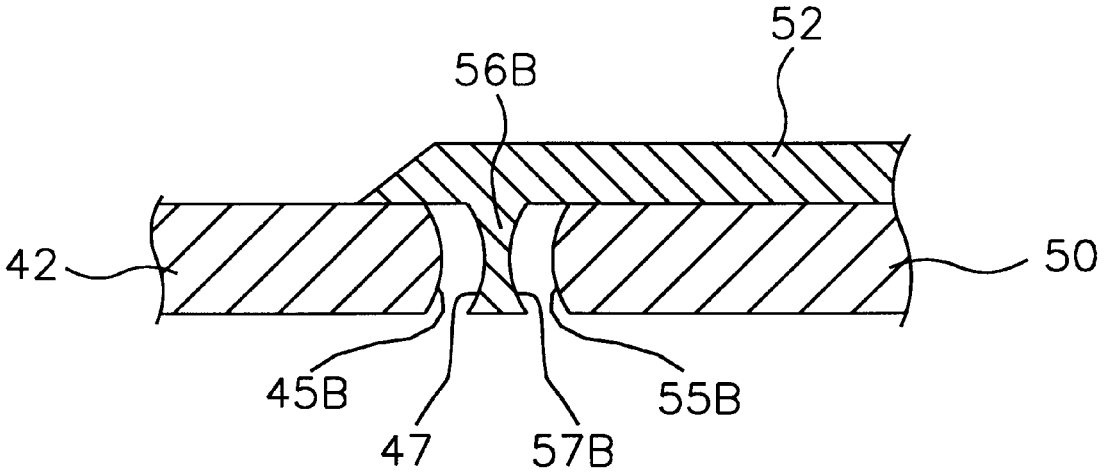
FIG. 6 is an enlarged side cross-sectional view of another modified embodiment of FIG. 4.
Figure 7:
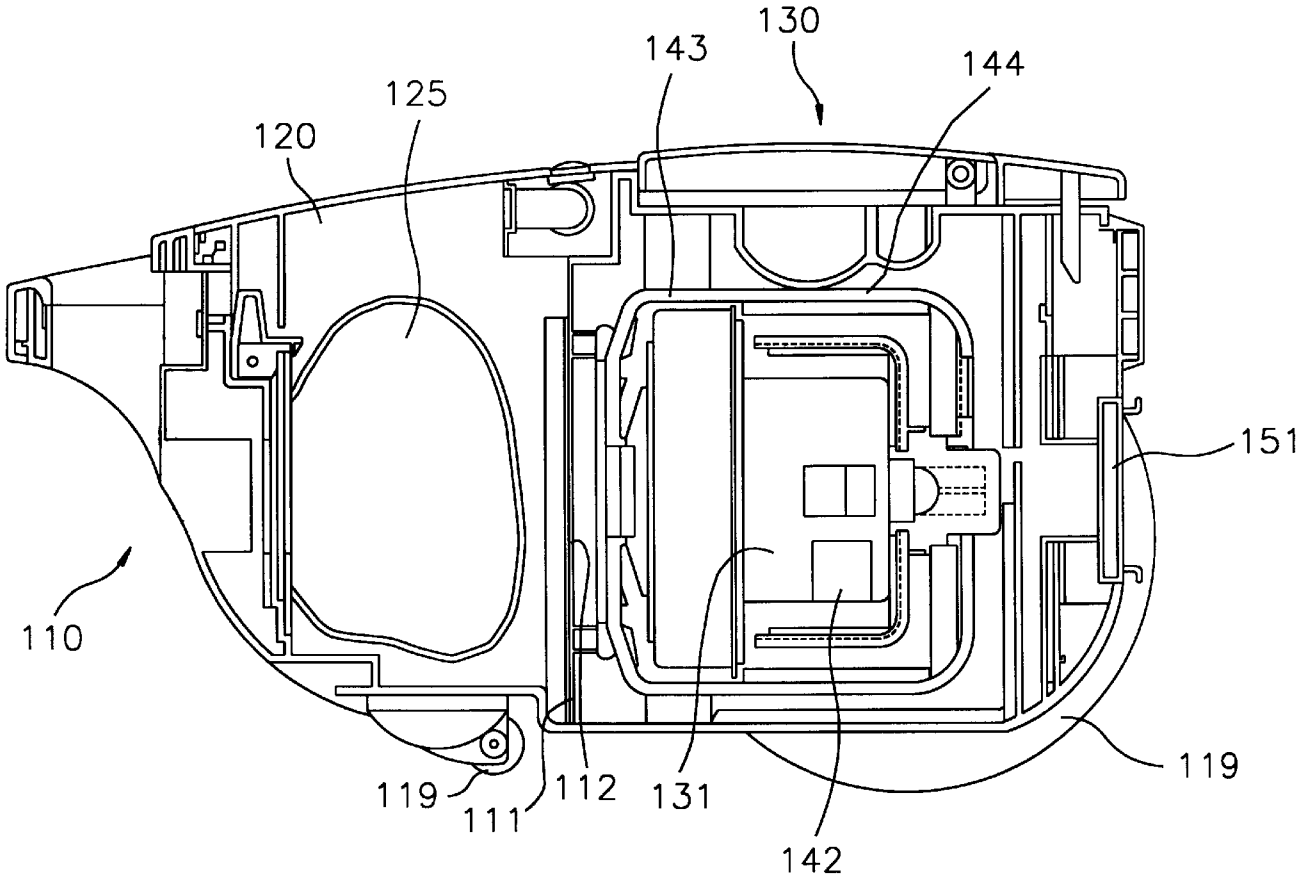
FIG.7 PRIOR ART
FIG. 7 is a side cross-sectional view of a body of vacuum cleaner according to a prior art.

Another embodiment modified to FIG. 4 is illustrated in FIG. 6. A protuberance 45B is formed at a circumference of the rear member 42 of the front casing, and a protuberance 55B is formed at a circumference of the rear casing 50. A protuberance 56B having recesses 47, 57 formed facing opposite one another is provided at the periphery of the second air guider 52 to receive protuberances 45B, 55B.

An opening 57 is provided at the lower portion of the second air guider 52 (FIG. 2), and plural ribs 57A distanced at even intervals from each other are provided on the opening 57 to give stiffness of the opening 57. The opening 57 is disposed at the portion far from the slot 53 of the first air guider 51, and the air discharging from the motor 60 passes through the opening 57. Finally the air can not pass directly to the outlet 59 of the rear casing 50. That is, the air moves more indirectly to the filter 70 housed in the outlet 59.

The vacuum cleaner according to the present invention constructed as above is operated as below.

The brush pipe is pushed on the surface to be cleaned, and power is applied to the vacuum cleaner, thus the motor 60 is operated. The dust laiden air is drawn into the dust collecting chamber 10 by the drawing force of the motor 60, and the dust is caught by the paper filter 13. The filtered air possibly having minor dust then passes through the opening 15 of the wall 17 and flows to the air blowing chamber 30. The air passing through the opening 41 of the front casing 40 further passes toward the inlet 61 of the motor 60, and leaves through the outlet 63. In the air flow path, the air is discharged through the opening 53 of the first air guider 51 which is formed at the place distanced from the outlet 63, thus decreasing noise of the air flow. Further, the air which is discharged through the opening 53 of the first air guider 51 flows toward the opening 57 of the second air guider 52. The air contained in the sealed space which is established by assembling the periphery of the second air guider 52 and the periphery of the front member 42 of the front casing exclusively flows to the rear casing 50 through the opening 57 without leaking through the joint portion.

Since the opening 57 of the second air guider 52 does not face the filter 70 of the rear casing 50, emerging noise of the motor 60 and the air flow through the filter 70 is decreased. Further, since the rear casing 50 is sealedly assembled with the front casing 40, the air drawn into the air blowing chamber 30 by the motor 60 exclusively passes through the filter 70 of the rear casing 50.

According to the vacuum cleaner of the present invention, the front casing and the rear casing enclose the motor, and the joint portion of both casings is sealedly assembled, thus all air discharged from the motor passes through the filter. Therefore, the exclusive clean air is discharged to the outside, thus providing a clean environment for the user.

Moreover, the first and the second air guiders are installed in the air blowing chamber, and emerging noise of the motor through the outside is decreased.

What is claimed is:

1. A low noise vacuum cleaner comprising, a dust collecting chamber having a paper filter for collecting dust intaken via a brush pipe, and an air blowing chamber partitioned by a wall having an air opening from the dust collecting chamber, both of the chambers laying on a surface to be cleaned, the air blowing chamber comprising, an air suction motor having an inlet for intaking the air from the dust collecting chamber, and having an outlet for discharging the intaken air;

a front casing having an air inlet;

a rear casing having a filter fitted to an air outlet through which the cleaned air is discharged parallel to the surface to be cleaned, and the two assembled casings instituting a space for housing the air suction motor;

a damper disposed between the motor and the front casing;

a first air guider housing the motor, and having plural air openings which are distanced from the air outlet of the motor; and a second air guider disposed between the first air guider and the rear casing, and having plural air openings which are provided to cause outlet air to move indirectly relative to the filter of the rear casing, wherein a periphery of the second air guider is disposed and provides a seal between the joint portion of the front casing and the rear casing.

2. The low noise vacuum cleaner as set forth in claim 1, wherein a protuberance is provided along the periphery of the second air guider, and recesses are provided along the jointing periphery of the front casing and the rear casing, respectively, for enveloping the protuberance.

3. The low noise vacuum cleaner as set forth in claim 1, wherein a protuberance is provided along the jointing periphery of the front casing and the rear casing, respectively, and recesses formed facing opposite one another are provided along the periphery of the second air guider, for receiving each protuberance.

* * * * *